US010047765B2

(12) United States Patent
Williamson et al.

(10) Patent No.: US 10,047,765 B2
(45) Date of Patent: Aug. 14, 2018

(54) BUSHING FOR A VARIABLE STATOR VANE AND METHOD OF MAKING SAME

(71) Applicant: General Electric Company, Schenectady, NY (US)

(72) Inventors: Aaron David Williamson, Taylors, SC (US); Harry McFarland Jarrett, Jr., Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 773 days.

(21) Appl. No.: 14/559,332

(22) Filed: Dec. 3, 2014

(65) Prior Publication Data

US 2016/0160675 A1 Jun. 9, 2016

(51) Int. Cl.
*F01D 17/16* (2006.01)
*F04D 29/56* (2006.01)
*F04D 29/64* (2006.01)

(52) U.S. Cl.
CPC ..... *F04D 29/563* (2013.01); *F01D 17/162* (2013.01); *F04D 29/644* (2013.01); *F05D 2230/70* (2013.01); *F05D 2250/182* (2013.01)

(58) Field of Classification Search
CPC ..... F01D 17/162; F04D 29/56; F04D 29/566; F04D 29/644; F04D 29/563; F05D 2250/182; F05D 2230/70; F16C 35/062; F16C 43/02; B23P 6/002; H01B 17/58
USPC ..... 29/280, 889.1; 384/271, 263, 261; 415/229, 159, 191, 193, 162, 160; 16/2.1–2.4
See application file for complete search history.

(56) References Cited

U.S. PATENT DOCUMENTS 4,494,290 A * 1/1985 Rutledge ..... B25B 9/02 188/239
4,916,791 A * 4/1990 Clouse ..... B25B 27/023 29/261
5,593,275 A 1/1997 Venkatasubbu et al.
2008/0298951 A1* 12/2008 Brault ..... F01D 17/105 415/58.5

FOREIGN PATENT DOCUMENTS

EP 545656 A1 6/1993
EP 757161 A2 2/1997
JP 4095834 B2 * 6/2008 ..... F01D 17/162

OTHER PUBLICATIONS

Translation of JP 4095834 B2 courtesy of Espacenet.*

* cited by examiner

*Primary Examiner* — Dwayne J White
*Assistant Examiner* — Danielle M Christensen
(74) *Attorney, Agent, or Firm* — Armstrong Teasdale LLP

(57) ABSTRACT

A bushing for use in a stator vane assembly that includes an annular body that extends between a first end and a second end. The bushing is configured to be removable from the stator vane assembly without disassembly of the stator vane assembly.

13 Claims, 11 Drawing Sheets

BUSHING FOR A VARIABLE STATOR VANE AND METHOD OF MAKING SAME

BACKGROUND

The field of the disclosure relates generally to stator vane assemblies for rotary machines and more particularly, to a bushing for use within a stator vane assembly.

At least some known rotary machines include a plurality of compressor stages that each include a row of stator vanes that direct air flow downstream towards a corresponding row of rotor blades. In at least some known rotary machines, at least some of the compressor stator vanes are rotatably coupled about a longitudinal vane axis that extends generally radially outward from the centerline of the rotary machine. The angular orientation of such "variable" stator vanes, relative to the airflow through the compressor, is adjustable to facilitate improved performance at a plurality of operating conditions.

At least some known variable stator vanes include a trunnion that extends through an opening defined in a casing of the compressor, and a generally annular bushing between the trunnion and the opening. The bushing facilitates decreasing friction between, and wear on, the trunnion and the casing. However, over time, at least some known bushings eventually require replacement due to operational wear. Typically, access to an interior of the casing and, in some cases, removal of a rotor of the rotary machine, is necessary to remove and replace such known bushings. Such required disassembly increases the time and costs associated with to replacing the bushings.

BRIEF DESCRIPTION

In one aspect, a bushing for use in a stator vane assembly in provided. The bushing includes an annular body that extends between a first end and a second end. The bushing is configured to be removable from the stator vane assembly without disassembly of the stator vane assembly.

In another aspect, a compressor for a rotary machine in provided. The compressor includes a casing and at least one variable stator vane assembly that is coupled to the casing. Each at least one variable stator vane assembly includes an airfoil that extends into a flow path defined through the compressor and a trunnion coupled to the airfoil. The trunnion extends through an opening defined in the casing. Each at least one variable stator vane assembly also includes a bushing between the trunnion and a wall that defines the opening. The bushing is configured to be removable from the at least one variable stator vane assembly without disassembly of the at least one variable stator vane assembly.

In another aspect, a method for fabricating a bushing that can be removed from a variable stator vane assembly without disassembly of the variable stator vane assembly is provided. The method includes forming an annular body extending between a first end and a second end. The method includes forming at least one key portion. Each at least one key portion defines a first circumferential width at a first axial distance from the body first end and by a second circumferential width at a second axial distance from the body first end. The second axial distance is longer than the first axial distance and the second circumferential width is wider than the first circumferential width.

DETAILED DESCRIPTION

The exemplary methods and systems described herein overcome at least some of the disadvantages associated with removal and replacement of bushings used with variable stator vane assemblies. The embodiments described herein include a bushing including at least one key portion that can be used to extract the bushing from the variable stator vane assembly without requiring access to an interior of a compressor casing.

For purposes of this disclosure, it should be understood that any term modified by the modifiers "substantially" or "approximately" encompasses variations of the term that do not result in a change in the basic function to which the term is related.

Figure 1:
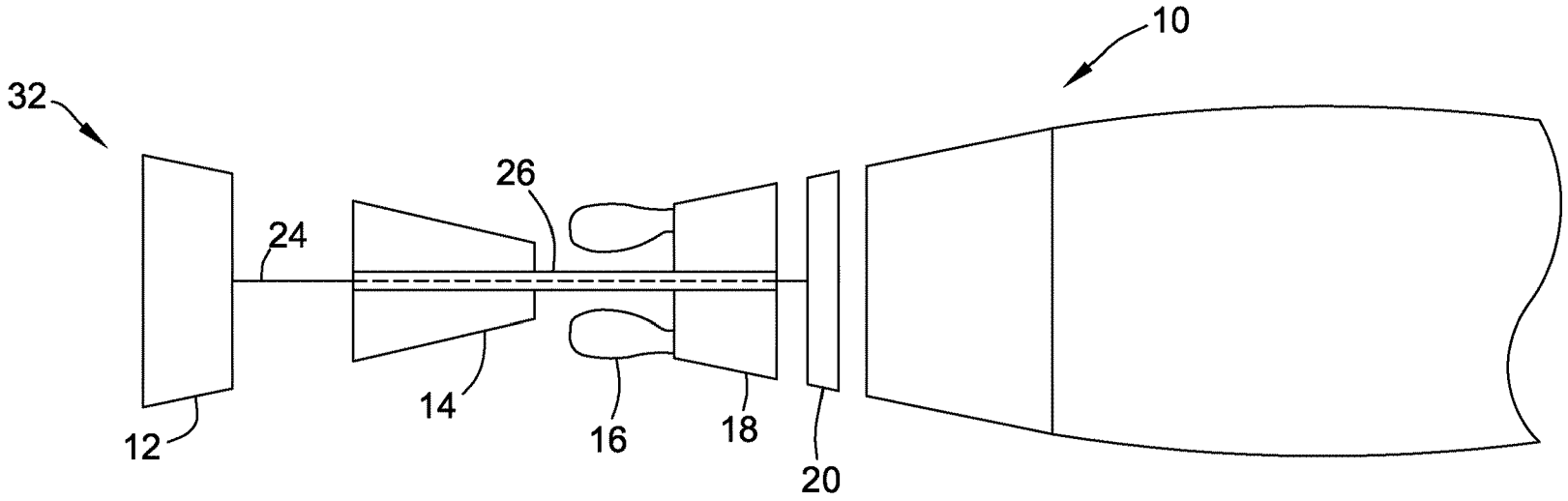
FIG. 1 is a schematic view of an exemplary rotary machine.

FIG. 1 is a schematic view of an exemplary rotary machine 10. In the exemplary embodiment, rotary machine 10 is a gas turbine that includes a low pressure compressor 12, a high pressure compressor 14, and a combustor assembly 16. Rotary machine 10 also includes a high pressure turbine 18 and a low pressure turbine 20 arranged in a serial, axial flow relationship. Low pressure compressor 12 and low pressure turbine 20 are coupled by a first shaft 24, and high pressure compressor 14 and high pressure turbine 18 are coupled by a second shaft 26. In alternative embodiments (not shown), rotary machine 10 is a gas turbine that includes a compressor and a turbine coupled by a single shaft. In other alternative embodiments (not shown), rotary machine 10 is any other rotary machine that is operable with variable stator vanes as described herein.

In operation, air flows through low pressure compressor 12 from an upstream side 32 of rotary machine 10, and compressed air is supplied from low pressure compressor 12 to high pressure compressor 14. From high pressure compressor 14, compressed air is delivered to combustor assembly 16, where it is mixed with fuel and ignited. The resulting combustion gases are channeled from combustor 16 to drive turbines 18 and 20.

Figure 2:
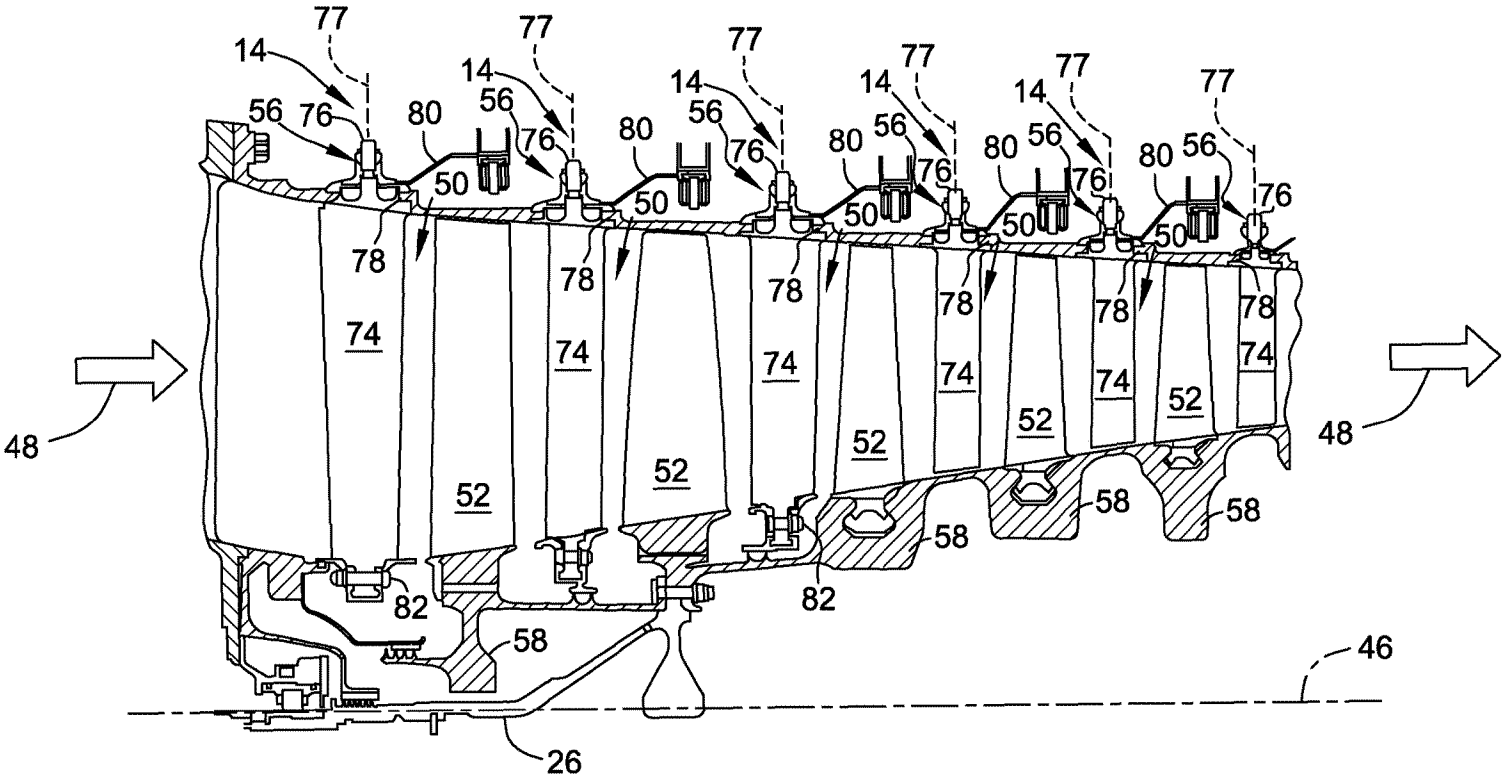
FIG. 2 is a schematic view of an exemplary compressor that may be used with the rotary machine shown in FIG. 1.
Figure 3:
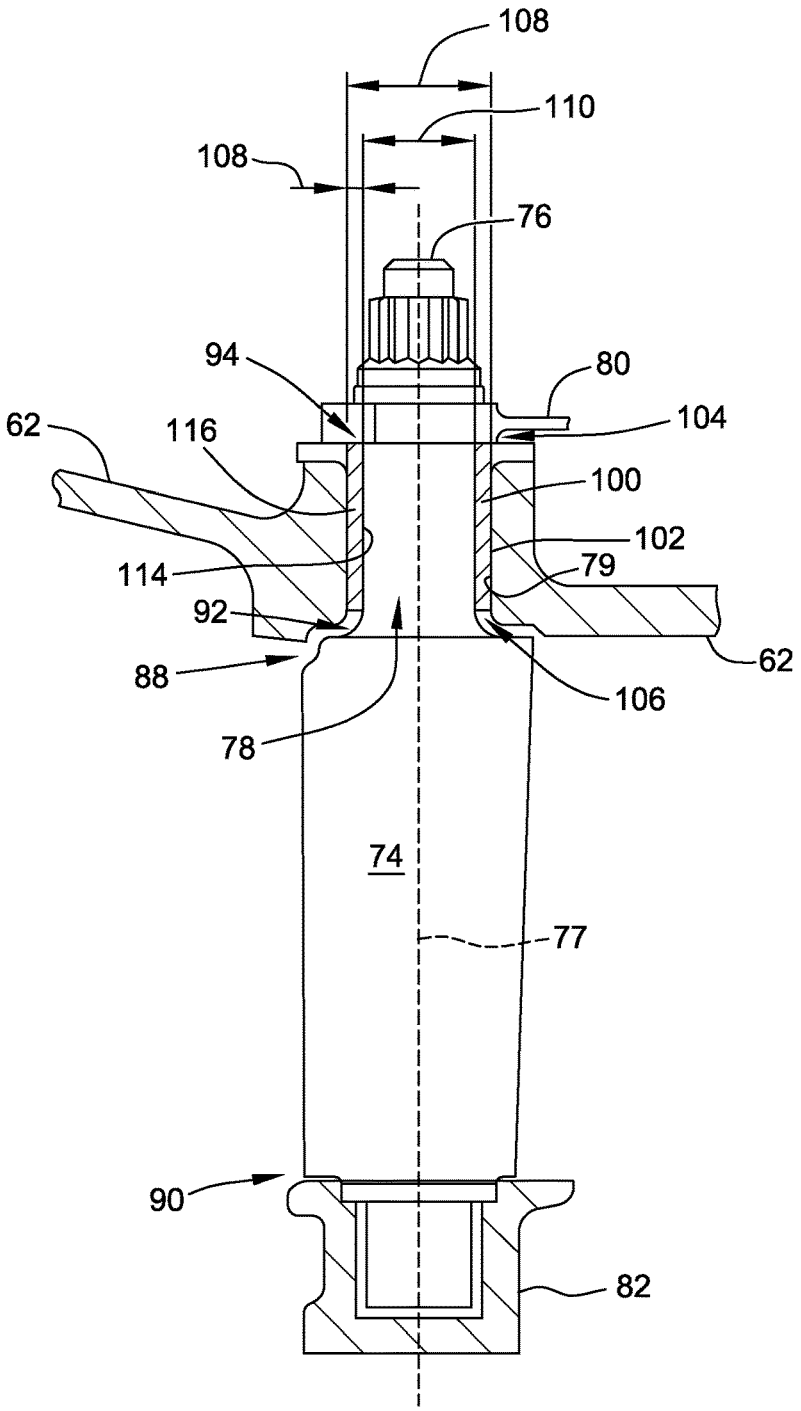
FIG. 3 is a schematic view of a portion of an exemplary variable stator vane assembly that may be used with the compressor shown in FIG. 2.

FIG. 2 is a schematic view of high pressure compressor 14. FIG. 3 is a schematic view of an exemplary portion of a variable stator vane assembly 56 coupled to high pressure compressor 14. In the exemplary embodiment, high pressure compressor 14 includes a plurality of stages 50. Each stage 50 includes a row of variable stator vane assemblies 56 that are each upstream from a corresponding row of rotor blades 52. Rotor blades 52 are supported by rotor disks 58 coupled to rotor shaft 26. Rotor shaft 26 is circumscribed by a casing 62 that supports variable stator vane assemblies 56.

Each variable stator vane assembly 56 includes an airfoil 74 that extends generally radially, with respect to a centerline 46 of high pressure compressor 14, from a radially outer first end 88 to a radially inner second end 90. Each variable stator vane assembly 56 also includes a trunnion 72 coupled to airfoil 74. Trunnion 72 extends from a radially inner first end 92, adjacent airfoil first end 88, to a radially outer second end 94. Trunnion 72 extends through an opening 78 defined in, and extending through, casing 62. Opening 78 is defined by a circumferentially-extending wall 79.

Variable stator vane assembly 56 also includes a trunnion seat 73 (shown in FIG. 5) coupled to trunnion 72. Trunnion seat 73 extends radially outwardly from trunnion second end 94 and a vane stem 76 is coupled to trunnion seat 73 such that each vane stem 76 extends generally radially outwardly from trunnion seat 73. A nut 84 removably coupled to vane stem 76 secures variable stator vane assembly 56 to casing 62. In some embodiments, at least some airfoils 74 also are coupled to a stationary inner casing 82.

Trunnion 72 and trunnion seat 73 couple airfoil 74 to a lever arm 80 for rotation about a longitudinal axis 77 of airfoil 74. More specifically, lever arm 80 is operable to adjust a rotational orientation of airfoil 74 about longitudinal axis 77. Airfoils 74 are positioned in a flow path defined through high pressure compressor 14, and the rotational orientation of airfoils 74 is selected to control an airflow 48 therethrough.

In the exemplary embodiment, airfoil 74, trunnion 72, and vane stem 76 are formed integrally together. In alternative embodiments, at least one of airfoil 74, trunnion 72, and/or vane stem 76 is formed independently from the others of airfoil 74, trunnion 72, and vane stem 76 and is then coupled thereto in any suitable fashion.

Variable stator vane assembly 56 also includes a bushing 100 between trunnion 72 and wall 79 of casing 62. Bushing 100 includes a body 102 that extends generally axially, with respect to longitudinal axis 77, between a body first end 104 and a body second end 106. Body 102 is annular in shape and centered on longitudinal axis 77, such that bushing 100 is slidably insertable between, and slidably removable from between, trunnion 72 and wall 79 of casing 62. Body 102 also extends radially, with respect to a center at longitudinal axis 77, from an inner surface 114 to an outer surface 116 to define a body thickness 112. Body 102 also extends circumferentially about longitudinal axis 77 and has an outer diameter 108 sized to fit within opening 78 of casing 62 in an interference fit, and an inner diameter 110 sized to receive trunnion 72 in a clearance fit that enables rotation of trunnion 72 and, thus, of airfoil 74 therein. In some embodiments, body 102 is formed from a material that enables low-friction rotation of trunnion 72 within bushing 100. In addition, bushing 100 includes key portion 120 (not visible in FIG. 3), described in more detail below, that facilitates removal of bushing 100 from variable stator vane assembly 56.

Figure 4:
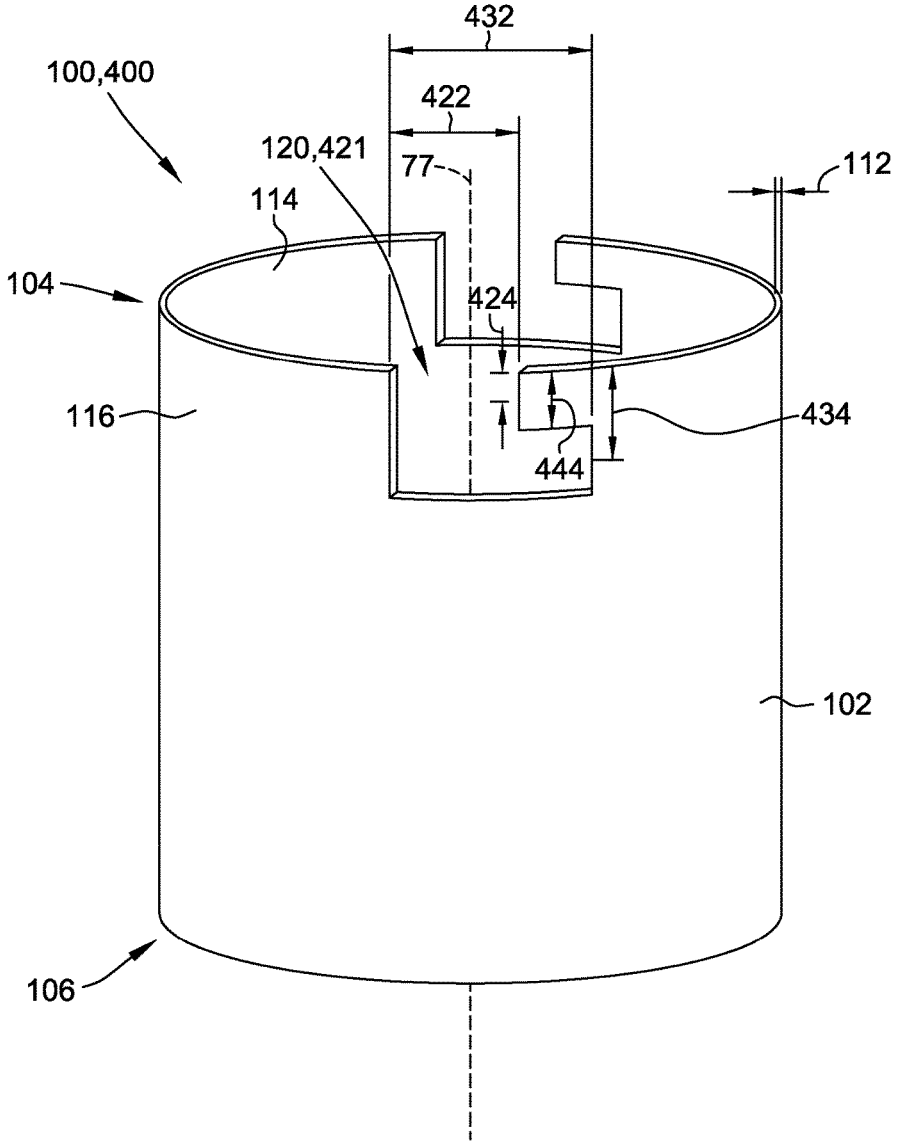
FIG. 4 is a perspective view of a first embodiment of a bushing that may be used with the variable stator vane assembly shown in FIG. 3.

FIG. 4 is a perspective view of a first exemplary bushing 100, designated as bushing 400, that may be used with variable stator vane assembly 56. As described above, body 102 extends axially between body first end 104 and body second end 106, and extends radially from inner surface 114 to outer surface 116. Bushing 400 also includes key portion 120. In the exemplary embodiment, key portion 120 is defined by a pair of oppositely-disposed key portions 120, and each key portion 120 has an identical shape and orientation. In an alternative embodiment, key portion 120 includes a pair of oppositely-disposed key portions 120, wherein the pair of key portions 120 are identically shaped in a mirrored relationship. In other alternative embodiments, key portion 120 includes a pair of key portions 120 that are not in a mirrored relationship and/or are not identically shaped. In other alternative embodiments, bushing 400 may include any suitable number of key portions 120 in any suitable arrangement that enables bushing 100 to function as described herein.

In the exemplary embodiment, each key portion 120 is at least partially defined by a cutout 421 formed in body 102. Each cutout 421 extends from body first end 104 towards body second end 106. Moreover, each cutout 421 extends from inner surface 114 to outer surface 116. Each key portion 120, as defined by cutout 421, is contiguous and has a first circumferential width 422 formed at a first axial distance 424 from body first end 104, and a second circumferential width 432 formed at a second axial distance 434 from body first end 104. Second axial distance 434 is greater than first axial distance 424, and second circumferential width 432 is wider than first circumferential width 422.

In an embodiment, each cutout 421 is formed within annular body 102 by stamping out a desired shape of cutout 421 from a sheet of material before the sheet material is shaped into annular body 102. In alternative embodiments, however, each cutout 421 is formed within annular body 102 by any suitable process. It should be understood that, although cutout 421 is referred to as a "cutout," in some embodiments cutout 421 may be formed without any use of cutting.

Because second circumferential width 432 is wider than first circumferential width 422, each contiguous key portion 120, as defined by cutout 421, defines at least one engagement surface 140 that extends at least partially circumferentially across an axial position extending between first axial distance 424 and second axial distance 434. More specifically, each key portion 120, as defined by cutout 421, includes at least one engagement surface 140 that (a) faces at least partially towards body second end 106, and (b) that is formed at a third axial distance 444 from body first end 104 that is longer than first axial distance 424 and shorter than second axial distance 434. For purposes of this disclosure, a surface, such as engagement surface 140, faces at least partially toward body second end 106 when a vector defined normal to the surface has a component that is parallel to longitudinal axis 77 that points toward body second end 106, and a surface at least partially faces away from body second end 106 when a vector defined normal to the surface has a component that is parallel to longitudinal axis 77 that points away from body second end 106. In the exemplary embodiment, third axial distance 444 is constant along the circumferential extent of engagement surface 140, such that engagement surface 140 is substantially parallel to body second end 106 and fully faces body second end 106. In alternative embodiments, third axial distance 444 varies along the circumferential extent of engagement surface 140.

Figure 6:
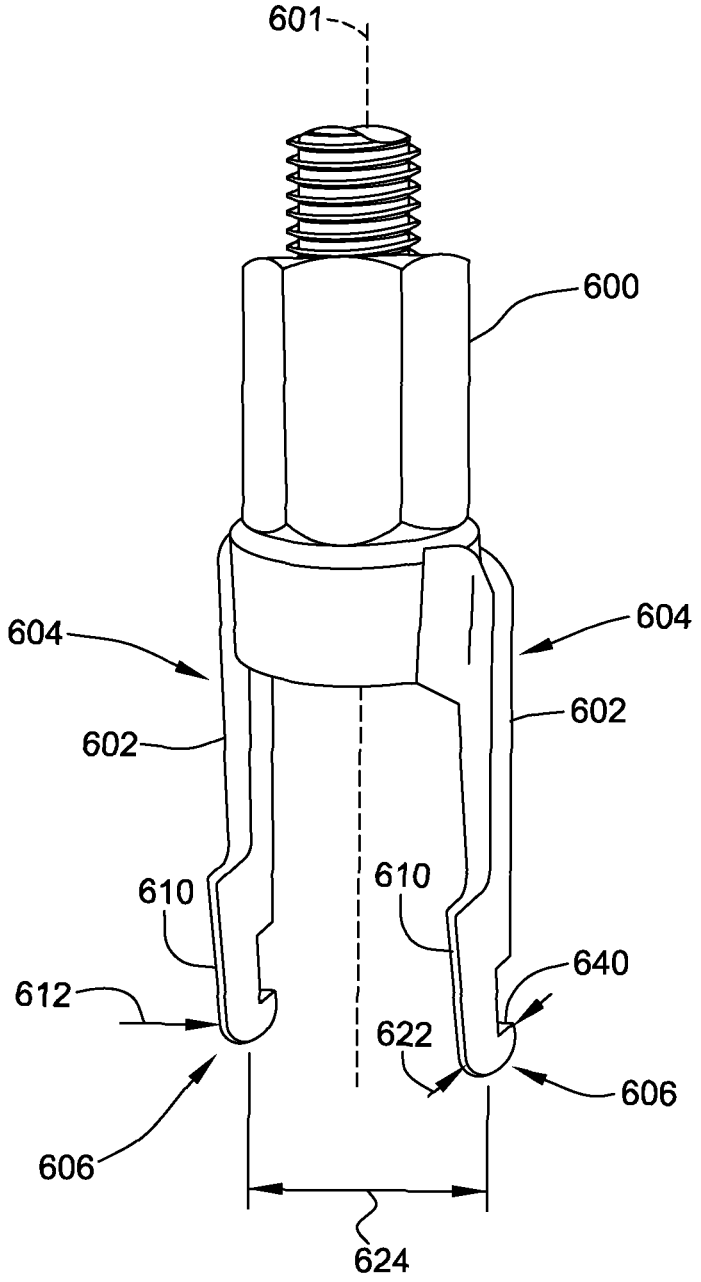
FIG. 6 is a perspective view of an exemplary tool that may be used to remove the bushing shown in FIG. 4 from the variable stator vane assembly shown in FIG. 3.

FIG. 6 is a perspective view of an exemplary tool 600 that may be used to remove bushing 100 from variable stator vane assembly 56 (shown in FIG. 3). In particular, in the exemplary embodiment, tool 600 is configured for use with bushing 400, shown in FIG. 4. With reference to FIGS. 4 and 6, tool 600 includes at least one arm 602. Each arm 602 extends axially, with respect to a tool axis 601, from a first end 604 to a distal second end 606. Tool second end 606 is insertable, from a radially outer side of casing 62, between trunnion 72 of variable stator vane assembly 56 and wall 79 of casing 62, to remove bushing 100 from variable stator vane assembly 56, without requiring access to an interior of casing 62.

In some embodiments, a corresponding arm 602 is included for each key portion 120 of bushing 100. In each embodiment. an extraction head 610 is proximate each arm second end 606. In particular, in the exemplary embodiment, the at least one arm 602 includes a pair of oppositely-disposed arms 602 that are separated by a distance 624 that is approximately the same length as inner diameter 110 of bushing 100. Distance 624 enables each extraction head 610 to simultaneously engage a corresponding one of the key portions 120 of bushing 400. In alternative embodiments, each extraction head 610 is on a separate tool. Each extraction head 610 has a thickness 612 that is less than, or equal to, body thickness 112 of bushing 100. Thus, when lever arm 80 is uncoupled from trunnion 72 and tool axis 601 is aligned with longitudinal axis 77, each extraction head 610 is insertable between trunnion 72 and wall 79, and is engageable with a corresponding key portion 120.

For example, with respect to the exemplary embodiment, each extraction head 610 has a width 622 that is narrower than first circumferential width 422. Thus, each extraction head 610 is insertable between trunnion 72 and wall 79, through body first end 104, and into a corresponding cutout 421. Each extraction head 610 includes contact surface 640 that at least partially faces away from body second end 106 when extraction head 610 is inserted between trunnion 72 and wall 79. Moreover, each extraction head 610 is shaped to engage a shape of key portion 120. For example, in some embodiments, each contact surface 640 has a shape that is at least partially complementary to a shape of the corresponding engagement surface 140. Tool 600 is either rotatable about tool axis 601 or is translatable, such that each contact surface 640 substantially mates against a corresponding engagement surface 140 of key portion 120.

In the exemplary embodiment, the pair of key portions 120 each have an identical shape and orientation, and tool 600 is translatable in a plane substantially transverse to tool axis 601, and such that tool 600 remains substantially parallel to tool axis 601 in a direction away from body second end 106, such that each contact surface 640 couples against a corresponding engagement surface 140. In an alternative embodiment, key portion 120 includes a pair of oppositely-disposed key portions 120 that have identical shapes in opposing orientations, and tool 600 is rotatable about tool axis 601, and is then translatable parallel to tool axis 601 in a direction away from body second end 106, such that each contact surface 640 couples against a corresponding engagement surface 140. In other alternative embodiments, any suitable combination of rotation of tool 600 about tool axis 601 and translation of tool 600 may be used that enables each contact surface 640 to couple against a corresponding engagement surface 140.

After each contact surface 640 is coupled against a corresponding engagement surface 140, tool 600 is movable in a direction away from compressor centerline 46 (shown in FIG. 2) to extract bushing 400 from between trunnion 72 and casing wall 79. For example, as tool 600 is moved substantially parallel to longitudinal axis 77 and away from compressor centerline 46, each contact surface 640 contacts each corresponding engagement surface 140, thus biasing the bushing 400 away from compressor centerline 46. After body second end 106 clears trunnion 72, bushing 400 can be uncoupled from tool 600, and a new bushing can be inserted between trunnion 72 and wall 79.

Figure 5:
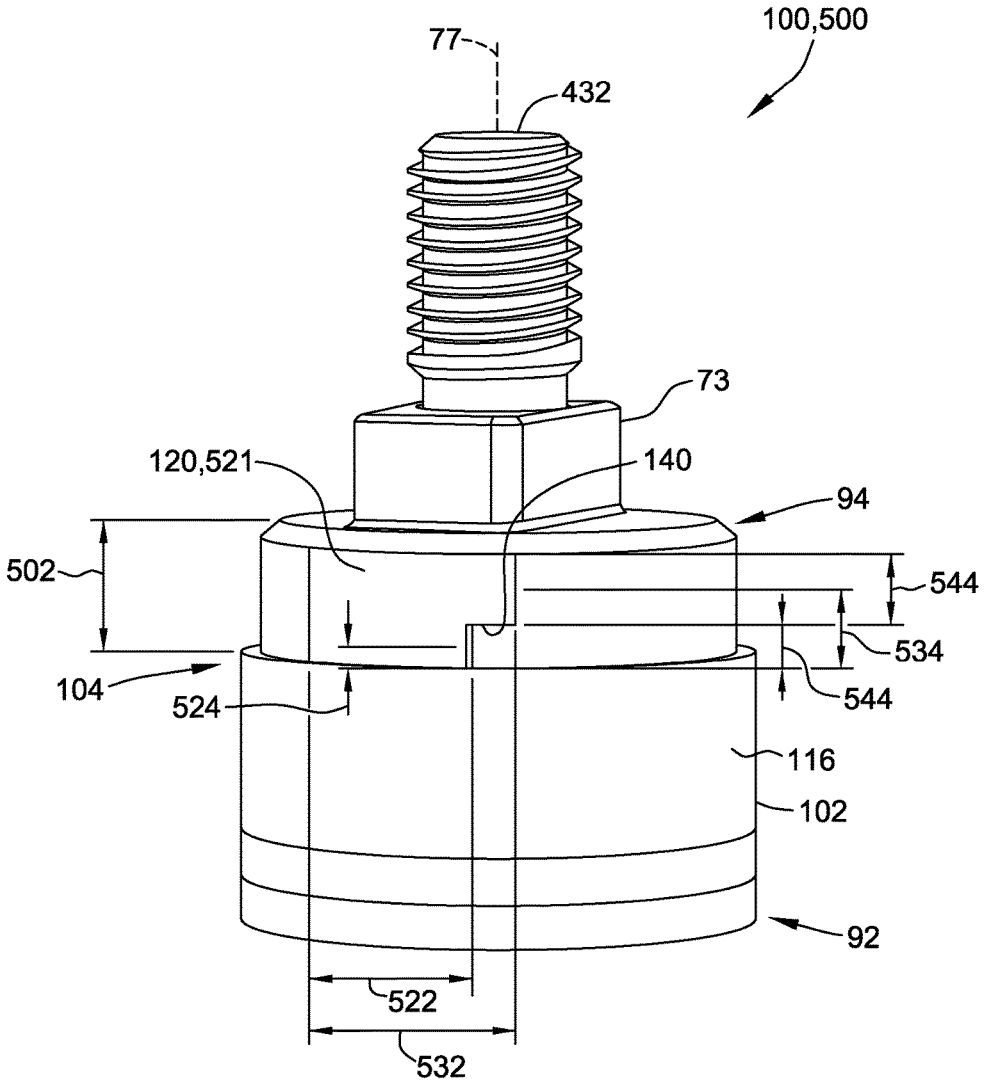
FIG. 5 is a perspective view of a second embodiment of a bushing that may be used with the variable stator vane assembly shown in FIG. 3.

FIG. 5 is a perspective view of a second exemplary embodiment of bushing 100, designated as bushing 500, that may be used with variable stator vane assembly 56. In FIG. 5, bushing 500 is shown coupled to trunnion 72 of variable stator vane assembly 56 to illustrate an operational position of bushing 500. As described above, bushing 500 includes body 102 that extends axially between body first end 104 and body second end 106, and that extends radially from inner surface 114 (not shown) to outer surface 116. Bushing 500 also includes key portion 120. In the exemplary embodiment, key portion 120 includes a pair of oppositely-disposed key portions 120, only one of which is visible in FIG. 5, and each of the pair of key portions 120 has an identical shape. In alternative embodiments, key portion 120 includes any suitable number of key portions 120 in any suitable arrangement, as described above.

In the exemplary embodiment, each key portion 120 is defined by a projection 521 that extends from body first end 104 away from body second end 106. In operation, body first end 104 is offset from trunnion second end 94 toward trunnion first end 92 by an offset distance 502, and each projection 521 has an axial extent less than or equal to offset distance 502, such that projections 521 do not interfere with a seating of lever arm 80 (shown in FIG. 3). Moreover, each projection 521 is within an extended annular space defined by body 102, such that bushing 500 including projections 521 is slidably insertable between, and slidably removable from between, trunnion 72 and wall casing 79 (shown in FIG. 3).

As described above, each key portion 120, as defined by projection 521, is contiguous and defines a first circumferential width 522 at a first axial distance 524 from body first end 104, and a second circumferential width 532 at a second axial distance 534 from body first end 104. Second axial distance 534 is greater than first axial distance 524, and second circumferential width 532 is wider than first circumferential width 522. Again, because second circumferential width 532 is wider than first circumferential width 522, the at least one engagement surface 140 extends at least partially circumferentially over an axial position defined between first axial distance 524 and second axial distance 534. More specifically, each key portion 120, as defined by projection 521, defines the at least one engagement surface 140 that (a) at least partially faces toward body second end 106, and (b) is at a third axial distance 544 from body first end 104 that is greater than first axial distance 524 and less than second axial distance 534. In the exemplary embodiment, third axial distance 544 is constant along the circumferential extent of engagement surface 140, such that engagement surface 140 is substantially parallel to body second end 106 and fully faces body second end 106. In alternative embodiments, third axial distance 544 varies along the circumferential extent of engagement surface 140.

With reference also to FIG. 6, it should be readily understood that embodiments of tool 600 may be used to remove bushing 500 from variable stator vane assembly 56 (shown in FIG. 3). In particular, for embodiments of bushing 100 that include a key portion that is a projection, such as projections 521, each extraction head 610 has a width 622 that is narrower than a circumferential width defined between adjacent key projections. Thus, each extraction head 610 is insertable between trunnion 72 and wall 79 to an axial depth corresponding to offset distance 502. Extraction heads 610 can be shaped in a suitable fashion to engage a shape of key portion 120, as defined by projections 521, in the same fashion as described above for key portion 120 as defined by cutouts 421 (shown in FIG. 4).

Although FIGS. 4 and 5 each illustrate an L-shaped key portion 120, various other shapes are contemplated, a few non-limiting examples of which are described below with reference to FIGS. 7-10.

Figure 7:
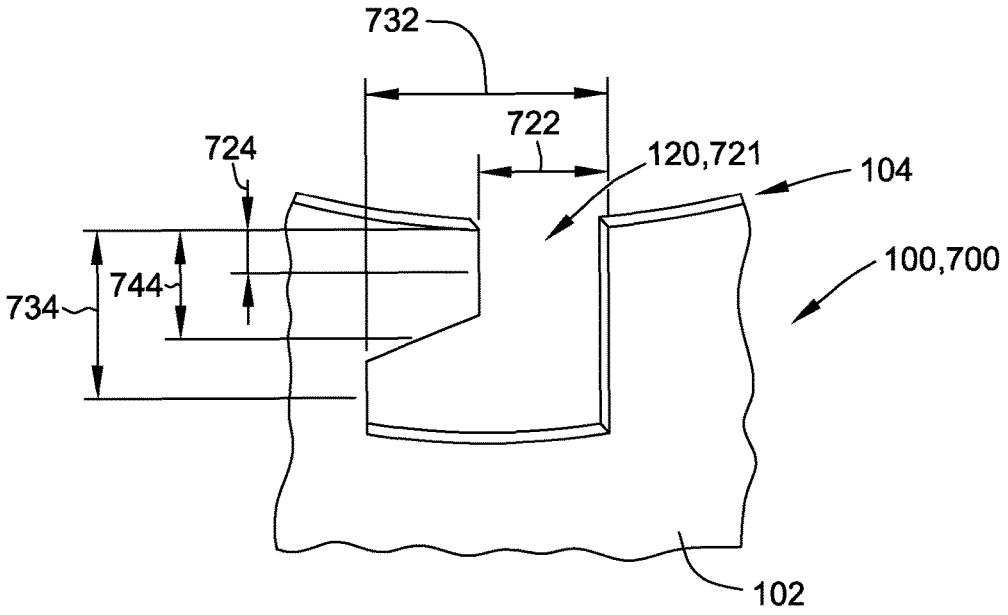
FIG. 7 is a perspective view of a third embodiment of a bushing that may be used with the variable stator vane assembly shown in FIG. 3.

FIG. 7 is a perspective view of a third exemplary embodiment of bushing 100, designated as bushing 700, that may be used with variable stator vane assembly 56. In the exemplary embodiment, key portion 120 is defined by at least one cutout 721 defined in body 102. Each key portion 120, as defined by cutout 721, is contiguous and defines a first circumferential width 722 at a first axial distance 724 from body first end 104, and a second circumferential width 732 at a second axial distance 734 from body first end 104. Second axial distance 734 is greater than first axial distance 724, and second circumferential width 732 is greater than first circumferential width 722. In the exemplary embodiment, the at least one engagement surface 140 is at a third axial distance 744 from body first end 104 that varies while remaining greater than first axial distance 424 and less than second axial distance 434. In particular, engagement surface 140 is at an angle relative to body second end 106 and partially faces toward body second end 106. With reference also to FIG. 6, it should be readily understood that the extraction heads 610 of tool 600 can be shaped in a suitable fashion to engage a shape of key portion 120 as defined by cutout 721. For example, in some embodiments, contact surface 640 is formed at an angle that is complementary to engagement surface 140 when contact surface 640 is oriented for coupling against engagement surface 140.

Figure 8:
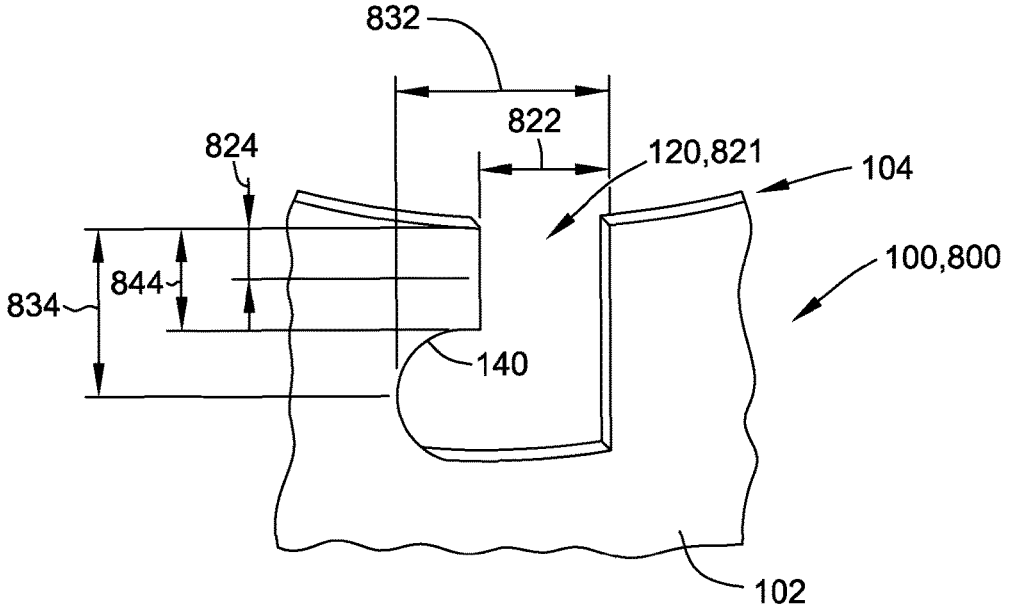
FIG. 8 is a perspective view of a fourth embodiment of a bushing that may be used with the variable stator vane assembly shown in FIG. 3.

FIG. 8 is a perspective view of a fourth exemplary embodiment of bushing 100, designated as bushing 800, that may be used with variable stator vane assembly 56. In the exemplary embodiment, key portion 120 is defined by at least one cutout 821 defined in body 102. Each key portion 120, as defined by cutout 821, is contiguous and defines a first circumferential width 822 at a first axial distance 824 from body first end 104, and a second circumferential width 832 at a second axial distance 834 from body first end 104. Second axial distance 834 is greater than first axial distance 824, and second circumferential width 832 is greater than first circumferential width 822. In the exemplary embodiment, the at least one engagement surface 140 is at a third axial distance 844 from body first end 104 that varies along a curve while remaining greater than first axial distance 824 and less than second axial distance 834. Engagement surface 140 thus is along a curve relative to body second end 106 and partially faces toward body second end 106. With reference also to FIG. 6, it should be readily understood that the extraction heads 610 of tool 600 can be shaped in a suitable fashion to engage a shape of key portion 120 as defined by cutout 821. For example, in some embodiments, contact surface 640 is formed with a curvature that is complementary to engagement surface 140 when contact surface 640 is oriented for coupling against engagement surface 140.

Figure 9:
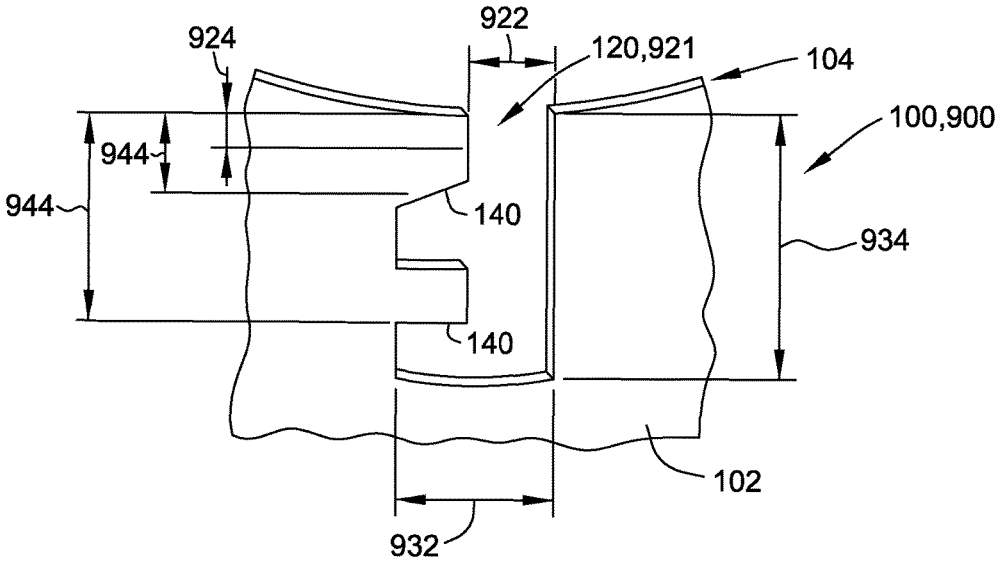
FIG. 9 is a perspective view of a fifth embodiment of a bushing that may be used with the variable stator vane assembly shown in FIG. 3.

FIG. 9 is a perspective view of a fifth exemplary embodiment of bushing 100, designated as bushing 900, that may be used with variable stator vane assembly 56. In the exemplary embodiment, key portion 120 is defined by at least one cutout 921 defined in body 102. Each key portion 120, as defined by cutout 921, is contiguous and defines a first circumferential width 922 at a first axial distance 924 from body first end 104, and a second circumferential width 932 at a second axial distance 934 from body first end 104. Second axial distance 934 is greater than first axial distance 924, and second circumferential width 932 is greater than first circumferential width 922. In the exemplary embodiment, the at least one engagement surface 140 is a plurality of engagement surfaces 140 each at a third axial distance 944 from body first end 104 that is greater than first axial distance 824 and less than second axial distance 834. In particular, a first engagement surface 140 is at an angle relative to body second end 106 and partially faces toward body second end 106, and a second engagement surface 140 is substantially parallel to body second end 106 and fully faces body second end 106. With reference also to FIG. 6, it should be readily understood that the extraction heads 610 of tool 600 can be shaped in a suitable fashion to engage a shape of key portion 120 as defined by cutout 921. For example, in some embodiments, extraction head 610 is formed with a plurality of contact surfaces 640, with each contact surface 640 corresponding to one of the plurality of engagement surfaces of cutout 921, and each contact surface 640 has a shape that is at least partially complementary to a shape of the corresponding engagement surface 140.

Figure 10:
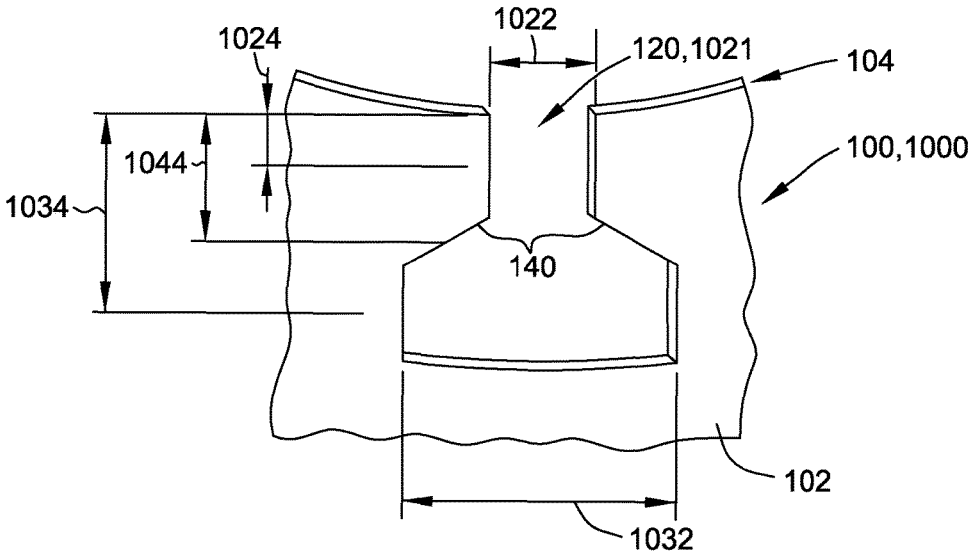
FIG. 10 is a perspective view of a sixth embodiment of a bushing that may be used with the variable stator vane assembly shown in FIG. 3.

FIG. 10 is a perspective view of a sixth exemplary embodiment of bushing 100, designated as bushing 1000, that may be used with variable stator vane assembly 56. In the exemplary embodiment, key portion 120 is defined by at least one cutout 1021 defined in body 102. Each key portion 120, as defined by cutout 1021, is contiguous and defines a first circumferential width 1022 at a first axial distance 1024 from body first end 104, and a second circumferential width 1032 at a second axial distance 1034 from body first end 104. Second axial distance 1034 is greater than first axial distance 1024, and second circumferential width 1032 is greater than first circumferential width 1022. In the exemplary embodiment, the at least one engagement surface 140 is a pair of oppositely-disposed engagement surfaces 140 each at a third axial distance 944 from body first end 104 that is greater than first axial distance 824 and less than second axial distance 834. In particular, each of the pair of engagement surfaces 140 is at an angle relative to body second end 106 and partially faces toward body second end 106. In alternative embodiments, at least one of the pair of opposing engagement surfaces 140 is one of parallel to body second end 106, curved, and any other suitable shape.

Figure 11:
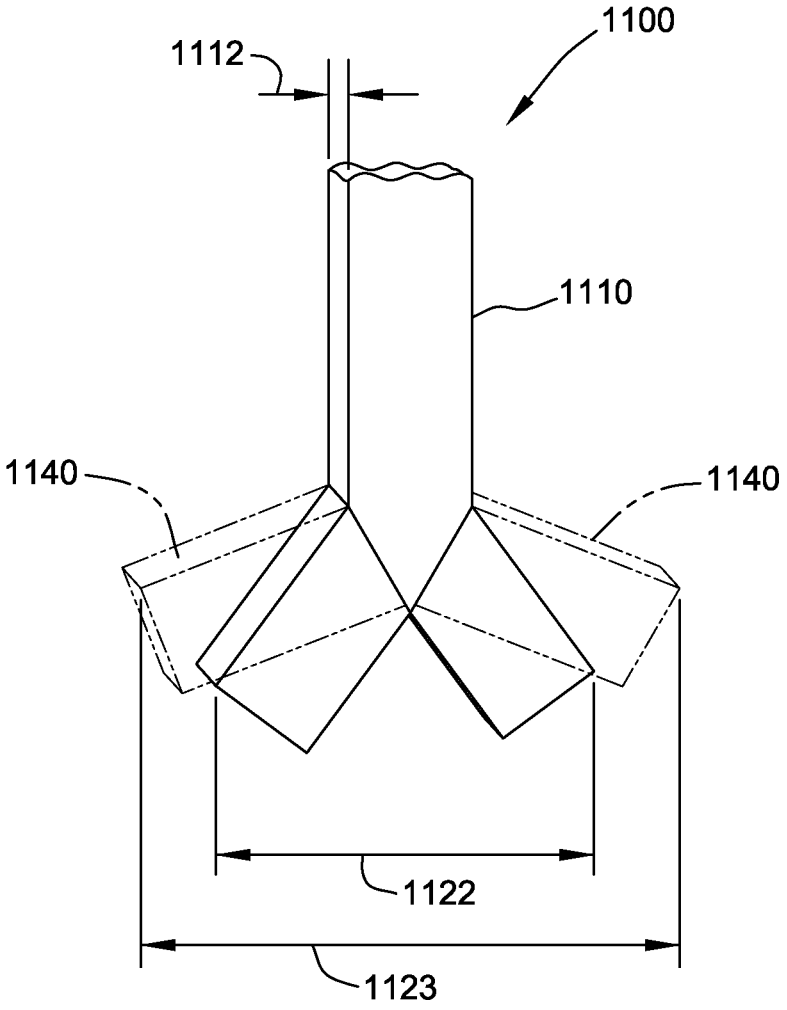
FIG. 11 is a perspective view of an exemplary embodiment of a tool arm that may be used with the tool shown in FIG. 6.

With reference also to FIG. 6, it should be readily understood that the extraction heads 610 of tool 600 can be shaped in any suitable shape that enables an engagement with key portion 120. However, in some embodiments, because each extraction head 610 has a width that is smaller than first circumferential width 622, tool 600 cannot simultaneously engage both oppossed engagement surfaces. FIG. 11 is a perspective view of an exemplary tool arm 1100 that may be used as tool arm 602 of tool 600 (shown in FIG. 6). In particular, in the exemplary embodiment tool arm 1100 is configured for use with bushing 1000 (shown in FIG. 10).

With reference to FIGS. 6, 10, and 11, tool arm 1100 includes an expandable extraction head 1110 that is movable between a retracted state (exemplary in solid lines in FIG. 11) and an expanded state (exemplary in dashed lines in FIG. 11). As described above with respect to extraction head 610, extraction head 1110 has a thickness 1012 that is less than or equal to body thickness 112 of bushing 100. Additionally, extraction head 1110, in the retracted state, has a width 1122 that is smaller than first circumferential width 1022. Thus, when lever arm 80 is uncoupled from trunnion 72 (shown in FIG. 3) and tool axis 601 is aligned with longitudinal axis 77, extraction head 1110 is insertable between trunnion 72 and wall 79 into key portion 120, as defined by cutout 1021.

Moreover, in the expanded state, extraction head 1110 includes oppositely-disposed contact surfaces 1140 that each at least partially face away from body second end 106 when extraction head 1110 is inserted between trunnion 72 and wall 79. Extraction head 1110 in the expanded state is shaped in a suitable fashion to engage a shape of key portion 120. For example, in some embodiments, extraction head 1110 in the expanded state has a width 1123 that is greater than first circumferential width 1122, and each contact surface 1140 has a shape that is at least partially complementary to a shape of the corresponding engagement surface 140. Tool 600 is either rotatable about tool axis 601 and/or is translatable such that each contact surface 1140 couples against a corresponding engagement surface 140 of key portion 120. As described above, after each contact surface 1140 is coupled against a corresponding engagement surface 140, tool 600 is movable substantially parallel to longitudinal axis 77 in a direction away from compressor centerline 46 (shown in FIG. 2) to extract bushing 400 from between trunnion 72 and wall 79 of casing 62. In alternative embodiments, tool 600 may include any suitable mechanism used to expand and retract extraction head 1110.

FIGS. 7-10 illustrate alternative embodiments of key portion 120. Although in FIGS. 7-10 key portion 120 is implemented as a cutout, it should be readily understood that similar shapes for key portion 120 may be implemented as a projection.

Figure 12:
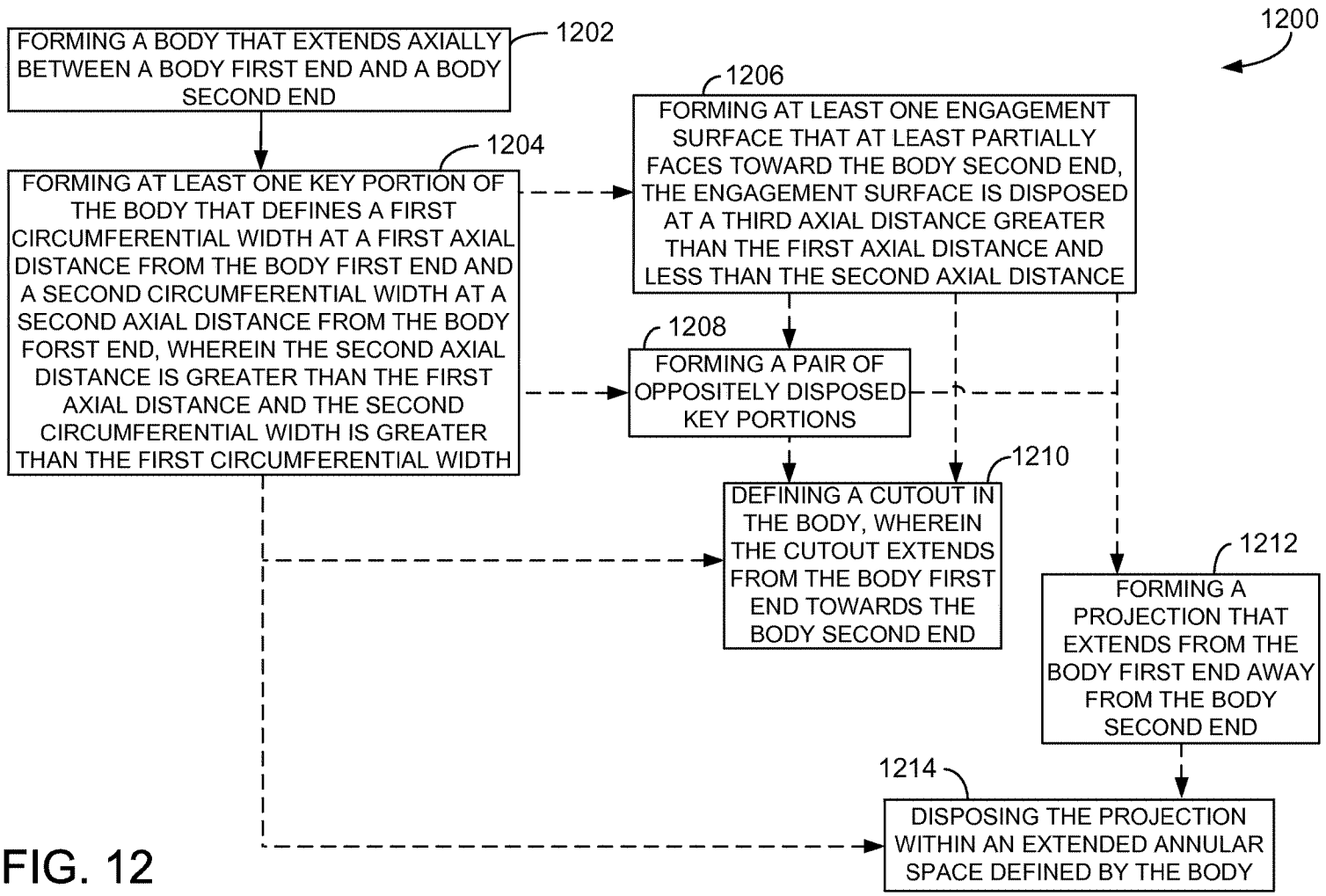
FIG. 12 is a flow diagram of an exemplary method of making a bushing for a variable stator vane assembly, such as the variable stator vane assembly shown in FIG. 3.

FIG. 12 is a flow diagram of an exemplary method 1200 of making a bushing, such as bushing 100, for a variable stator vane assembly, such as variable stator vane assembly 56. With reference to FIGS. 1-5, 7-10, and 12, method 1200 includes forming 1202 a body, such as body 102, that extends axially between a body first end, such as body first end 104, and a body second end, such as body second end 106. The body is annular. Method 1200 also includes forming 1204 at least one key portion of the body, such as key portion 120, such that each at least one key portion is contiguous. Each at least one key portion defines a first circumferential width, such as first circumferential width 422, 522, 722, 822, 922, or 1022, at a first axial distance from the body first end, such as first axial distance 424, 524, 724, 824, 924, or 1024. Each at least one key portion also defines a second circumferential width, such as second circumferential width 432, 532, 732, 832, 932, or 1032, at a second axial distance from the body first end, such as first axial distance 434, 534, 734, 834, 934, or 1034. The second axial distance is greater than the first axial distance, and the second circumferential width is greater than the first circumferential width.

In some embodiments, method 1200 includes additional steps which are connected by dashed lines in FIG. 12. For example, in some embodiments, forming 1204 the at least one key portion includes forming 1206 at least one engagement surface, such as engagement surface 140, that at least partially faces toward the body second end. The at least one engagement surface is at a third axial distance from the body first end, such as third axial distance 444, 544, 744, 844, 944, or 1044. The third axial distance is greater than the first axial distance and less than the second axial distance. In some embodiments, forming 1204 the at least one key portion includes forming 1208 a pair of oppositely-disposed key portions.

In some embodiments, forming 1204 the at least one key portion includes defining 1210 a cutout in the body, such as cutout 421, 721, 821, 921, or 1021. The cutout extends from the body first end towards the body second end. Alternatively, in some embodiments, forming 1204 the at least one key portion includes forming 1212 a projection, such as projection 521, that extends from the body first end away from the body second end. In some embodiments, forming 1212 the projection includes disposing 1214 the projection within an extended annular space defined by the body.

Figure 13:
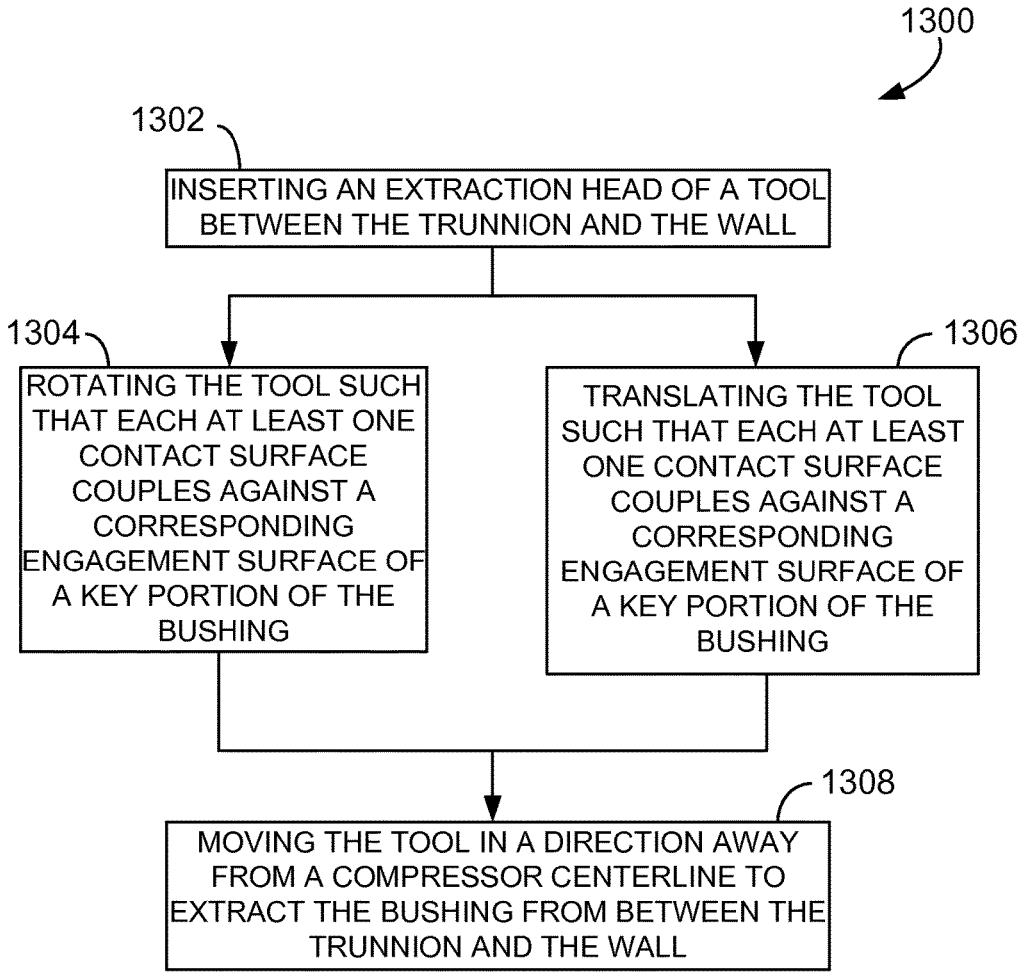
FIG. 13 is a flow diagram of an exemplary method of removing a bushing from a variable stator vane assembly, such as the variable stator vane assembly shown in FIG. 3.

FIG. 13 is a flow diagram of an exemplary method 1300 of removing a bushing, such as bushing 100, from a variable stator vane assembly, such as variable stator vane assembly 56, of a compressor, such as high pressure compressor 14. With reference to FIGS. 1-11, the bushing is between a trunnion of the variable stator vane assembly, such as trunnion 72, and a wall that defines an opening in a casing of the compressor, such as wall 79 that defines opening 78 of casing 62. The trunnion extends through the opening. Method 1300 includes inserting 1302 an extraction head of a tool, such as extraction head 610 or 1110 of tool 600, between the trunnion and the wall. The extraction head includes at least one contact surface, such as contact surface 640 or 1140, that at least partially faces away from a body second end, such as body second end 106, of the bushing. Method 1300 also includes at least one of rotating 1304 the tool and translating 1306 the tool such that each at least one contact surface couples against a corresponding engagement surface of a key portion of the bushing, such as engagement surface 140 of key portion 120. Method 1300 further includes moving 1308 the tool in a direction away from a compressor centerline, such as compressor centerline 46, to extract the bushing from between the trunnion and the wall.

Exemplary embodiments of bushings, methods of forming a bushing, and tools and methods for removing a bushing from a variable stator vane assembly are described above in detail. The embodiments provide at least an advantage in enabling extraction of the bushing from the variable stator vane assembly without requiring access to an interior of a compressor casing. For example, the key portion includes an engagement surface that couples against a corresponding contact surface of the tool when the tool is inserted from an exterior of the casing. The key portion may be a cutout defined in a body of the bushing, or alternatively a projection that extends from the body.

The apparatuses, systems, and methods described herein are not limited to the specific embodiments described herein. For example, components of systems and/or steps of the methods may be utilized independently and separately from other components and/or steps described herein. In addition, each component and/or step may also be used and/or practiced with other assemblies and methods. Although specific features of various embodiments of the disclosure may be shown in some drawings and not in others, this is for convenience only. In accordance with the principles of the disclosure, any feature of any drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A compressor comprising:

a casing; and at least one variable stator vane assembly coupled to said casing, wherein each said variable stator vane assembly comprises:

an airfoil that extends into a flow path defined through said compressor;

a trunnion coupled to said airfoil, said trunnion extends through an opening defined in said casing; and a bushing between said trunnion and a wall that defines said opening, wherein said bushing comprises:

an annular body extending between a first end and a second end; and at least one projection that extends from said body first end away from said body second end, each said at least one projection defines a first circumferential width at a first axial distance from said body first end and a second circumferential width at a second axial distance from said body first end, wherein the second axial distance is longer than the first axial distance, and wherein the second circumferential width is wider than the first circumferential width.

2. The bushing of claim 1, wherein each said at least one projection comprises at least one engagement surface that at least partially faces toward said body second end, said at least one engagement surface extends at a third axial distance from said body first end, wherein the third axial distance is longer than the first axial distance and shorter than the second axial distance.

3. The bushing of claim 1, wherein said at least one projection comprises a pair of oppositely-disposed projections located on opposing portions of said annular body.

4. The bushing of claim 1, wherein said at least one projection extends from an extended annular space defined by said body.

5. A compressor for a rotary machine, said compressor comprising:

a casing; and at least one variable stator vane assembly coupled to said casing, wherein each said variable stator vane assembly comprises:

an airfoil that extends into a flow path defined through said compressor;

a trunnion coupled to said airfoil, said trunnion extends through an opening defined in said casing; and a bushing between said trunnion and a wall that defines said opening, said bushing being configured to be removable from said at least one variable stator vane assembly, without disassembly of said at least one variable stator vane assembly, wherein said bushing comprises an annular body extending between a first end and a second end, said annular body defining at least one key portion extending into said annular body from said first body end, each said at least one key portion defines a first circumferential width at a first axial distance from said body first end and a second circumferential width at a second axial distance from said body first end, and wherein the second axial distance is longer than the first axial distance, and the second circumferential width is wider than the first circumferential width.

6. The bushing of claim 5, wherein each said at least one key portion is further defined by at least one engagement surface that at least partially faces toward said body second end, said at least one engagement surface extends at a third axial distance from said body first end, wherein the third axial distance is longer than the first axial distance and shorter than the second axial distance.

7. The bushing of claim 5, wherein said at least one key portion comprises a pair of oppositely-disposed key portions located on opposing portions of said annular body.

8. The bushing of claim 5, wherein each said at least one key portion comprises a cutout defined in said body, said cutout extends from said body first end towards said body second end.

9. The bushing of claim 8, wherein said cutout extends radially from an inner surface of said body to an outer surface of said body.

10. A method of assembling a variable stator vane assembly, said method comprising:

coupling a trunnion to a casing such that the trunnion extends through an opening defined in the casing, wherein the trunnion is coupled to an airfoil that extends into a flow path defined through the casing; and coupling a bushing between the trunnion and a wall that defines the opening, wherein the bushing includes:

an annular body extending between a first end and a second end; and at least one key portion extending into the annular body from the first end, each at least one key portion defines a first circumferential width at a first axial distance from the body first end and a second circumferential width at a second axial distance from the body first end, wherein the second axial distance is longer than the first axial distance, and wherein the second circumferential width is wider than the first circumferential width.

11. The method of claim 10, wherein said coupling the bushing further comprises coupling the bushing that includes at least one engagement surface that at least partially faces toward the body second end, the at least one engagement surface extends at a third axial distance from the body first end, wherein the third axial distance is longer than the first axial distance and shorter than the second axial distance.

12. The method of claim 10, wherein said coupling the bushing further comprises coupling the bushing that includes a pair of oppositely-disposed key portions located on opposing portions of the annular body.

13. The method of claim 10, wherein said coupling the bushing further comprises that the at least one key portion is a cutout defined in the body, wherein the cutout extends from the body first end towards the body second end.

* * * * *